US006273628B1

(12) United States Patent
Chen

(10) Patent No.: US 6,273,628 B1
(45) Date of Patent: Aug. 14, 2001

(54) SHOE-BASE CLEANING APPARATUS WITH JACK MEANS FOR FILLING OF CLEANING SOLUTION

(76) Inventor: Chao-Yang Chen, 8F-3, No. 321, Fu Shin S. Rd., Sec. 1, Taipei (TW)

( * ) Notice: Subject to any disclaimer, the term of this patent is extended or adjusted under 35 U.S.C. 154(b) by 0 days.

(21) Appl. No.: 09/768,342

(22) Filed: Jan. 25, 2001

(51) Int. Cl.[7] ..... A47L 13/282

(52) U.S. Cl. ..... 401/203; 401/6; 15/227; 36/136

(58) Field of Search ..... 401/6, 203, 204, 401/196, 201; 15/227, 104.94; 36/98, 103, 136

(56) References Cited

U.S. PATENT DOCUMENTS 1,287,487 * 10/1918 Smith ..... 401/196
2,075,850 * 4/1937 Johnson ..... 401/203
2,790,191 * 4/1957 Johnson ..... 401/203
3,359,591 * 12/1967 McGuire ..... 401/203
3,362,775 * 1/1968 Meucke ..... 401/6
3,969,026 * 7/1976 Johnson ..... 401/196
4,945,599 * 8/1990 Flynn ..... 15/227
5,473,788 * 12/1995 Aragona ..... 15/227
5,921,003 * 7/1999 Kim ..... 36/136
6,052,856 * 4/2000 DeMoya et al. ..... 15/227
6,134,741 * 10/2000 Spalione ..... 15/227

* cited by examiner

*Primary Examiner*—Charles R. Eloshway
(74) *Attorney, Agent, or Firm*—Bacon & Thomas, PLLC

(57) ABSTRACT

The invention relates to a shoe-base cleaning apparatus with jack means for filling of cleaning apparatus, which includes an upper, and an unit bottom formed of a sock, a side wall, a wiper, and at least one jack for the filling of cleaning solution or water wax into the wiper. The sidewall extends along the peripheral area of the sock, defining with the sock a receiving chamber. The wiper is mounted in the receiving chamber. The at least one jack is respectively mounted in the side wall for the filling of cleaning solution into the wiper, each formed of a hollow shell and a hollow stud press-fitted into the hollow shell.

8 Claims, 3 Drawing Sheets

SHOE-BASE CLEANING APPARATUS WITH JACK MEANS FOR FILLING OF CLEANING SOLUTION

BACKGROUND OF THE INVENTION

1. Field of the Invention

The present invention relates to cleaning apparatus and, more particularly, to a shoe-base cleaning apparatus with jack means for replenish of cleaning solution.

2. Description of Related Art

When cleaning the floor, people may move the wiper with the legs over the floor. It is uncomfortable to step the foot on the wet, cold wiper. It is also inconvenient to move the wiper over the floor with the foot or the toes, or to apply cleaning solution or water wax to the wiper during cleaning.

Therefore, it is desirable to provide a cleaning apparatus that eliminates the aforementioned problems.

SUMMARY OF THE INVENTION

The main object of the present invention is to provide a shoe-base cleaning apparatus, which can be put on the foot for cleaning the floor conveniently. Another object of the present invention is to provide a shoe-base cleaning apparatus, which can be conveniently filled with cleaning solution for cleaning.

To achieve the aforesaid objects, the shoe-base cleaning apparatus of the present invention comprises a unit bottom and an upper. The unit bottom comprises a sock, a sidewall, a wiper, and at least one jack. The sidewall is connected to the peripheral area of the sock, defining with the sock a receiving chamber. The wiper is mounted in the receiving chamber. The at least one jack is respectively mounted in the side wall for the filling of cleaning solution into the wiper, each formed of a hollow shell and a hollow stud press-fitted into the hollow shell. In order to protect the upper against water, the sock and the sidewall are made of waterproof cloth. The waterproof cloth and its stitching are of the known art not within the scope of the invention. For the filling of cleaning solution into the wiper in the receiving chamber, the sidewall is provided with at least one through hole to which a respective jack is fastened. Through the jack in each through hole of the sidewall, clean water, soap water, liquid detergent, solvent, water wax, and etc., is filled into the wiper inside the receiving chamber. Each jack may be provided with a one-way valve to prevent leakage. The wiper of the shoe-base cleaning apparatus is similar to the structure of the insole or out sole of a regular shoe. It can be made of foamed material, sponge, cotton cloths, non-woven cloths, tissues, or other fabrics. Regular wiper materials can be used for the wiper of the shoe-base cleaning apparatus. When cleaning solution or the like is filled into one jack of the shoe-base cleaning apparatus, the wiper immediately absorbs it. For easy washing, the wiper can be made detachable. In order to provide a wide wiping area, the wiper is made having a wiper body detachably mounted in the receiving chamber, and a wiper head formed integral with the wiper body and extended out of the unit bottom.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
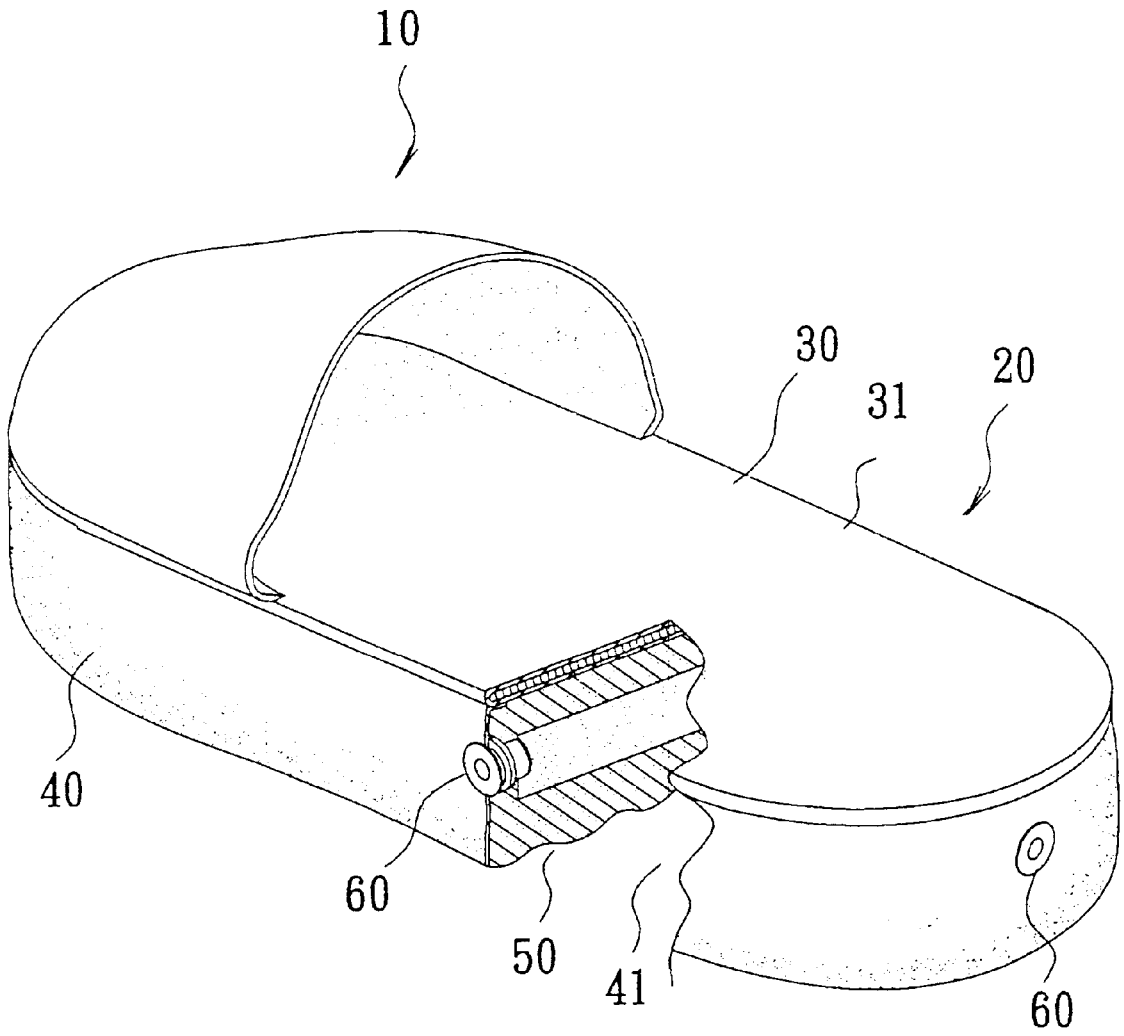
FIG. 1 is a cutaway of a shoe-base cleaning apparatus according to one embodiment of the present invention.

With reference to FIG. 1, there is shown a shoe-base cleaning apparatus constructed according to a first embodiment of the present invention. The shoe-base cleaning apparatus is generally comprised of an upper 10, and a unit bottom 20. The unit bottom 20 comprises a sock 30, a sidewall 40, a wiper 50, and at least one jack 60.

The sidewall 40 extends along the border area 31 of the sock 30, defining with the sock 30 a receiving chamber 41. The wiper 50 fits the receiving chamber 41. Further, the sidewall 40 is provided with a plurality of jacks 60 through which cleaning solution or the like is filled into the shoe-base cleaning apparatus.

Figure 2:
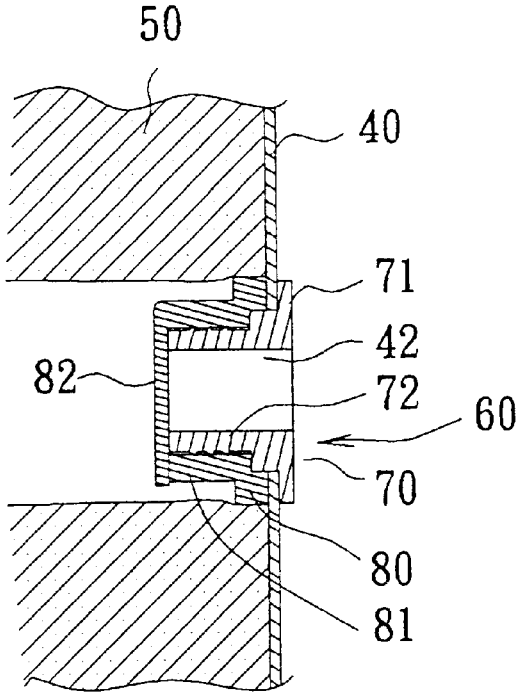
FIG. 2 is a sectional view of the shoe-base cleaning apparatus shown in FIG. 1.

Referring to FIG. 2, the jack 60 is fastened to one through hole 42 on the sidewall 40, comprised of a hollow stud 70 and a socket-like hollow shell 80. The hollow shell 80 is attached to the inner side of the sidewall 40 around the through hole 42, having a tubular back extension 81. The hollow stud 70 comprises a tubular shank 72 press-fitted into the tubular back extension 81 of the hollow shell 80, and an outward top flange 71 pressed on the outer side of the side wall 40 around the through hole 42 to secure the hollow shell 80 to the side wall 40. Because the jack 60 is formed of a hollow stud 70 and a socket-like hollow shell 80 matching the hollow stud 70, it can easily be fastened to the through hole 42 without the use of hand tool means. Further, the jack 60 protects the side wall 40 against tearing upon insertion of nozzle means to fill cleaning solution or the like into the shoe-base cleaning apparatus (see FIG. 2).

Figure 4:
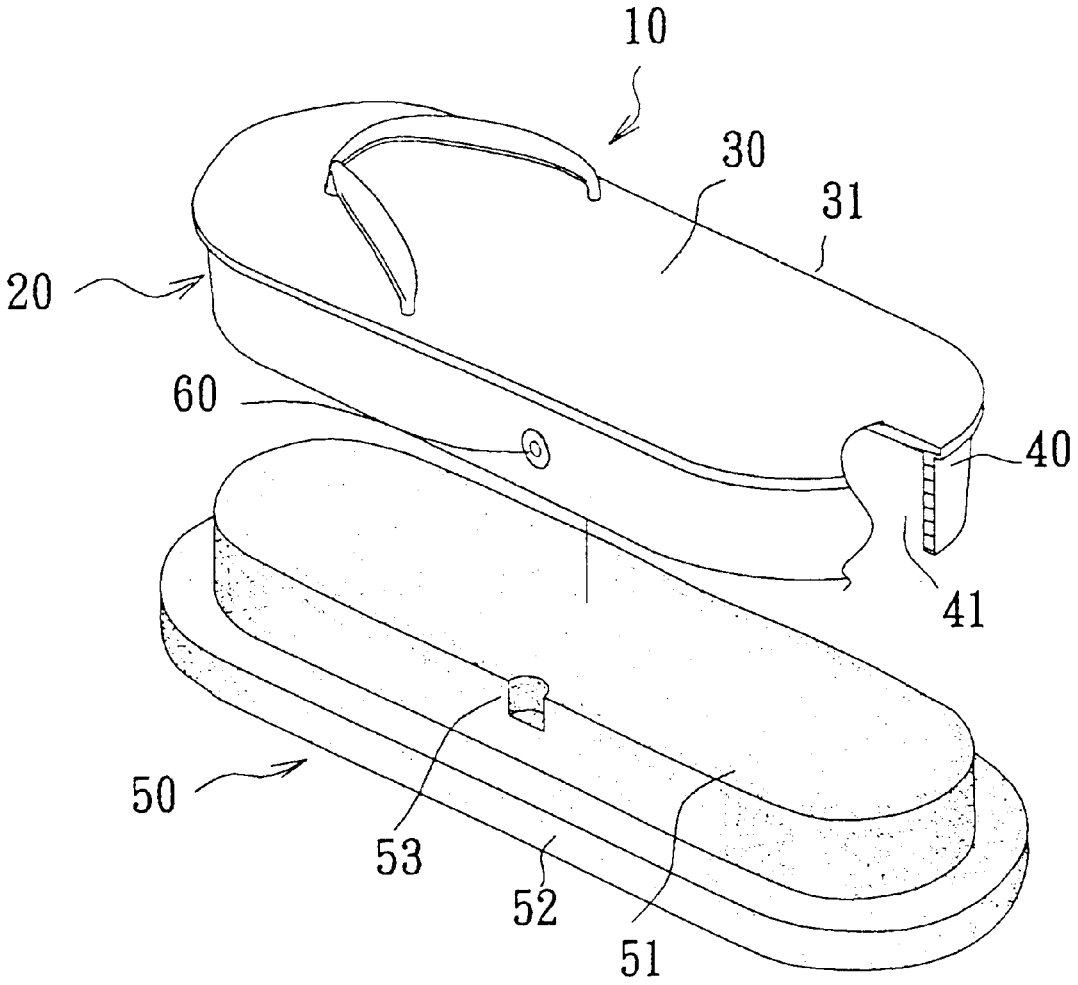
FIG. 4 is an exploded view of a shoe-base cleaning apparatus according to a second embodiment of the present invention.

FIG. 4 shows a shoe-base cleaning apparatus according to a second embodiment of the present invention. According to this embodiment, the wiper 50 is detachably fastened to the receiving chamber 41, comprising a wiper body 51 fitting the receiving chamber 41, a wiper head 52 integral with the wiper body 51 and stopped outside the unit bottom 20, and a plurality of guide grooves 53 corresponding to the jacks 60 and adapted to guide cleaning solution into the wiper body 51 and the wiper head 52. The wiper 50 of this alternate form provides a relatively broader area for cleaning. Further, because the wiper 50 is detachable, it can easily be removed from the unit bottom 20 for washing or replacement.

Figure 3:
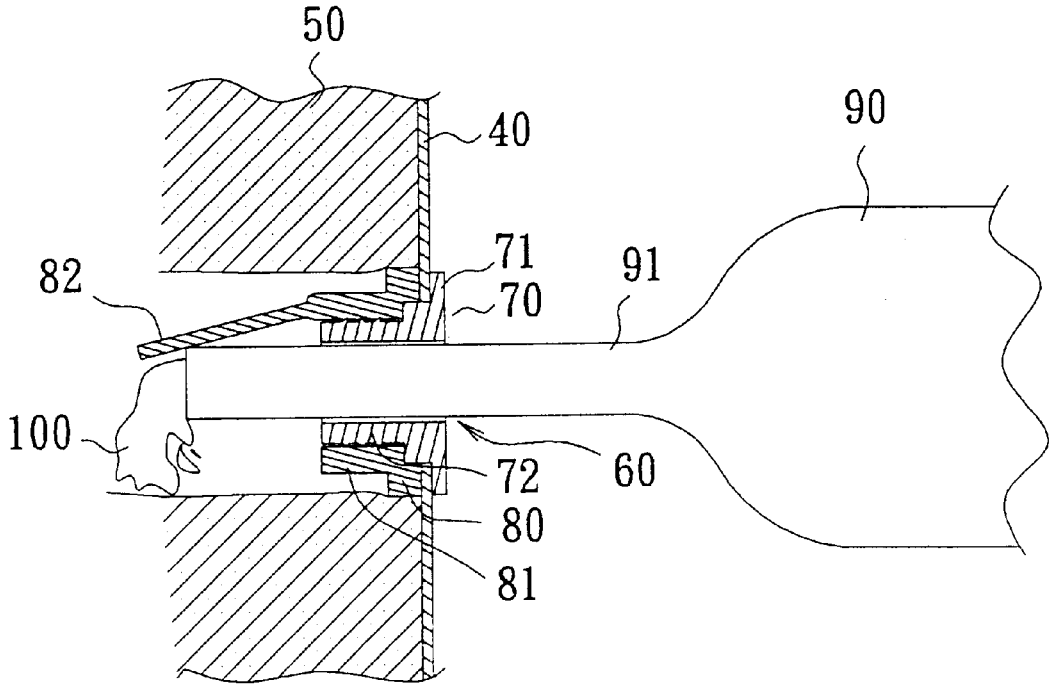
FIG. 3 illustrates the nozzle of the cleaning solution container inserted through the jack, the one-way valve opened according to the present invention.

Referring to FIGS. 2 and 3, a one-way valve 82 is provided in the tubular back extension 81 of the hollow shell 80 of each jack 60. When inserting the nozzle 91 of a cleaning solution container 90 into the tubular shank 72 of the hollow stud 70, the one-way valve 82 is opened, for enabling cleaning solution 100 to be filled into the receiving chamber 41 and absorbed by the wiper 50 (see also FIGS. 1 and 4). After removal of the nozzle 91 from the jack 60, the one-way valve 82 automatically closes the passage of the tubular shank 72 of the hollow stud 70, preventing a leakage of cleaning solution.

Although the present invention has been explained in relation to its preferred embodiment, it is to be understood that many other possible modifications and variations can be made without departing from the spirit and scope of the invention as hereinafter claimed.

What is claimed is:

1. A shoe-base cleaning apparatus having an upper and a unit bottom, said unit bottom comprising:

a sock, said sock having a peripheral area;

a sidewall connected to said sock along the peripheral area of said sock and defining with said sock a receiving chamber;

a wiper mounted in said receiving chamber; and at least one jack respectively mounted in said side wall for the filling of cleaning solution into said wiper in said receiving chamber, said at least one jack each comprising a hollow shell having a closure mechanism, and a hollow stud press-fitted into said hollow shell.

2. The shoe-base cleaning apparatus as claimed in claim 1, wherein said side wall comprises at least one through hole to which said at least one jack is respectively fastened.

3. The shoe-base cleaning apparatus as claimed in claim 1, wherein said hollow shell comprises a tubular back extension, and said hollow stud comprises a tubular shank body press-fitted into the tubular back extension of said hollow shell and an outward top flange stopped at an outer side of said side wall against said hollow shell.

4. The shoe-base cleaning apparatus as claimed in claim 3 wherein said closure mechanism is connected to said tubular back extension of said hollow shell to define a one-way valve adapted to control the passage of cleaning solution there through said tubular shank body of said hollow stud.

5. The shoe-base cleaning apparatus as claimed in claim 4 wherein the number of said at least one jack is at least 2.

6. The shoe-base cleaning apparatus as claimed in claim 1 wherein said wiper is detachably inserted into said receiving chamber.

7. The shoe-base cleaning apparatus as claimed in claim 1 wherein said wiper comprises at least one guide groove respectively aimed at said at least one jack.

8. The shoe-base cleaning apparatus as claimed in claim 1 wherein said wiper comprises a wiper body detachably inserted into said receiving chamber and a wiper head integral with said wiper body and extending outwardly from a bottom thereof.

* * * * *